US007117561B1

(12) United States Patent
Domenig et al.

(10) Patent No.: US 7,117,561 B1
(45) Date of Patent: Oct. 10, 2006

(54) LOW PROFILE HINGE WITH THREE-DIMENSIONAL MECHANICAL ADJUSTMENT

(75) Inventors: Georg Domenig, Kernersville, NC (US); Jeffery W. Morgan, High Point, NC (US)

(73) Assignee: Grass America Inc., Kernersville, NC (US)

( * ) Notice: Subject to any disclaimer, the term of this patent is extended or adjusted under 35 U.S.C. 154(b) by 22 days.

(21) Appl. No.: 11/066,040

(22) Filed: Feb. 25, 2005

(51) Int. Cl.
*E05D 7/04* (2006.01)

(52) U.S. Cl. ..... 16/236

(58) Field of Classification Search ..... 16/235, 16/236, 238, 242, 246, 237, 265, 382, 258, 16/254, 240, 351, 271, DIG. 43; 403/322.4
See application file for complete search history.

(56) References Cited

U.S. PATENT DOCUMENTS

| | | | | |
|---|---|---|---|---|
| 4,716,622 | A | 1/1988 | DeBruyn | |
| 5,295,282 | A | 3/1994 | Lautenschlager | |
| 5,392,493 | A | 2/1995 | Youngdale | |
| 5,511,287 | A | 4/1996 | Lautenschlager et al. | |
| 5,603,142 | A * | 2/1997 | Dubach et al. | 16/247 |
| 5,621,947 | A * | 4/1997 | Fitz et al. | 16/249 |
| 5,737,804 | A * | 4/1998 | Ferrari et al. | 16/242 |
| 5,964,010 | A * | 10/1999 | Huber | 16/237 |
| 6,032,333 | A * | 3/2000 | Brustle | 16/242 |
| 6,240,599 | B1 | 6/2001 | Peer et al. | |
| 6,266,848 | B1 * | 7/2001 | Fraccaro et al. | 16/245 |
| 6,442,798 | B1 * | 9/2002 | Rupprechter | 16/242 |
| 6,578,232 | B1 * | 6/2003 | Salice | 16/235 |
| 6,615,452 | B1 * | 9/2003 | Mueller et al. | 16/242 |
| 6,647,591 | B1 * | 11/2003 | Domenig et al. | 16/242 |
| 6,739,019 | B1 * | 5/2004 | Schnelle et al. | 16/235 |
| 6,845,544 | B1 * | 1/2005 | Hofer | 16/246 |
| 6,880,205 | B1 * | 4/2005 | Rupprechter | 16/235 |
| 6,918,158 | B1 * | 7/2005 | Isele | 16/235 |
| 7,017,231 | B1 * | 3/2006 | Isele | 16/242 |
| 2006/0137139 | A1 | 6/2006 | Wu | |
| 2006/0143859 | A1 | 7/2006 | Wu | |

FOREIGN PATENT DOCUMENTS

DE 0346633 A1 * 12/1989

* cited by examiner

*Primary Examiner*—Robert J. Sandy
*Assistant Examiner*—Andre' L. Jackson
(74) *Attorney, Agent, or Firm*—John M. Harrington; Kilpatrick Stockton LLP

(57) ABSTRACT

Hinge assembly for mounting a door on a furniture frame for movement of the door between open and closed positions of the door relative to the furniture frame comprising a mounting plate adapted to be affixed to a furniture frame member an intermediate plate disposed atop of and slideably engaged to said mounting plate a top plate disposed atop of and slideably engaged to said intermediate plate and said mounting plate, and further comprising a hinge arm extending from a front portion thereof, and a guide pin extending through a rearward portion of said top plate, through a rearward portion of said intermediate plate, and through a rearward portion of said mounting plate such that said top plate is pivotable upon said guide pin. Further, the hinge assembly is adjustable such that the hinge arm can be adjusted in three dimensions relative to the mounting plate.

6 Claims, 3 Drawing Sheets

LOW PROFILE HINGE WITH THREE-DIMENSIONAL MECHANICAL ADJUSTMENT

FIELD OF THE INVENTION

The present invention relates generally to hinge devices for mounting a door on a furniture article, and more particularly to adjustable hinge devices for hanging doors on cabinets or the like so that the doors can be adjusted relative to the supporting frame they are attached to.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282, 5,392,493, and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

Three-dimensionally adjustable hinges of the prior art generally encompass one of two forms. In one such prior art design, the height adjustment of the door is accomplished by loosening the mounting screw or screws which extend into the wood furniture frame, adjusting the hinge vertically, then tightening the wood screws to secure the hinge in position. This is a cumbersome method of adjusting the hinge and often leads to deterioration of the wood and eventual failure of the hinge to support the weight of the door. In another prior art hinge design, a series of adjustment screws are provided; however, they are not capable of independent interaction. The adjustment of one screw necessarily requires adjustment of a second screw. This is due, primarily, to simplify the design of such a hinge. It would, therefore, be desirable to provide a hinge with three-dimensional mechanical adjustment means which are independent of one another and do not require adjustment of the mounting screw.

The mechanics of adjustable hinge components require various hinge plates to slide upon one another. The hinge components require small tolerances between them so as to minimize play between the components and to securely retain a furniture door in place. Further, the hinge components must support the weight of the door and the stresses associated with opening and closing during operation. As the door moves between an open and a closed position, the forces acting on the various components of the hinge mounting assembly can change dramatically. This has the potential to adversely affect the components and cause excess wear or damage. The additional components required for three dimensional mechanical adjustment must be precisely designed so as to tolerate these stresses, but not interfere with the mechanics of the hinge.

SUMMARY OF THE INVENTION

In a first aspect of the present invention, a hinge assembly for mounting a door on a furniture frame for movement of the door between open and closed positions of the door relative to the furniture frame is provided comprising a mounting plate adapted to be affixed to a furniture frame member an intermediate plate disposed atop of and slideably engaged to said mounting plate a top plate disposed atop of and slideably engaged to said intermediate plate and said mounting plate, and further comprising a hinge arm extending from a front portion thereof, and a guide pin extending through a rearward portion of said top plate, through a rearward portion of said intermediate plate, and through a rearward portion of said mounting plate such that said top plate is pivotable upon said guide pin. Further, the hinge assembly is adjustable such that the hinge arm can be adjusted in three dimensions relative to the mounting plate.

In one embodiment of the present invention, the top plate further comprises a body portion having an elongated aperture in said body portion of said top plate positioned proximate to one side of said top plate and elongated in a direction parallel to said side, said top plate disposed atop of and slideably engaged to said intermediate plate and said mounting plate, and a cam screw extending through said elongated aperture in the top plate and engaging an aperture associated with said intermediate plate. By rotating said cam screw about an eccentric axis in said elongated aperture, said top plate moves from side to side relative to said intermediate plate and said mounting plate, thereby adjusting the hinge cup and said door up and down relative to said furniture frame.

In a further embodiment of the present invention, the top plate further comprises a first and second side member depending from either side thereof each comprising an aperture, said intermediate plate further comprises a first and second side flange each comprising an aperture, said mounting plate comprises a first and second side members each comprising an elongated aperture. Additionally, the said hinge assembly further comprising a guide pin extending through said aperture in said first side member of the top plate, said aperture in said first elongated aperture of said mounting plate, said aperture in said first side flange of said intermediate plate, across the body of said intermediate plate, and into said aperture in said second flange of said intermediate plate, said elongated aperture in said side member of said mounting plate, and into said aperture in said second side member of said top plate.

In another embodiment of the present invention, the mounting plate further comprises a leg depending from said front end and said rear end in a direction opposite said side members, said legs positioned and aligned to engage and secure said mounting plate to said furniture frame.

In a still further embodiment of the present invention, the mounting plate comprises two front catch members located on said side members proximate to the front of the mounting plate and angled inward.

An additional embodiment of the present invention provides the hinge assembly further comprises a front threaded screw extending through an aperture in said top plate configured for receiving and engaging the threads of the threaded screw, and extending into an aperture associated with said intermediate plate. Rotating said threaded screw causes the top plate to ride up and down along the threads of the screw thereby moving the hinge cup and door from left to right with respect to the furniture frame.

In a preferred embodiment of the present invention, the hinge assembly further comprises a clip positioned between said mounting plate and said intermediate plate wherein a portion of said clip is raised and protrudes through an aperture in said intermediate plate, and wherein said aperture associated with said intermediate plate comprises a circular aperture formed in said raised portion of said clip.

In an additional preferred embodiment of the present invention, the hinge assembly further comprises a rear cam screw positioned proximate a rear portion of the hinge assembly and extending through an elongated aperture in said rear portion of the intermediate plate elongated in a direction parallel to said rear portion, and into a circular aperture in a rear portion of said mounting plate, such that by rotating the rear cam screw, the intermediate plate slides front to rear relative to the base plate, said pin and said top plate with a hinge arm connected to the hinge cup moving with said intermediate plate, thereby causing the furniture door to move in and out relative to the furniture frame.

It is a feature and advantage of the present invention to provide a hinge with three-dimensional mechanical adjustment means which are independent of one another and do not require adjustment of the mounting screw.

Features of a hinge assembly of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

As will be realized by those of skill in the art, many different embodiments of a hinge assembly according to the present invention are possible. Additional uses, objects, advantages, and novel features of the invention are set forth in the detailed description that follows and will become more apparent to those skilled in the art upon examination of the following or by practice of the invention.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION

Figure 1:
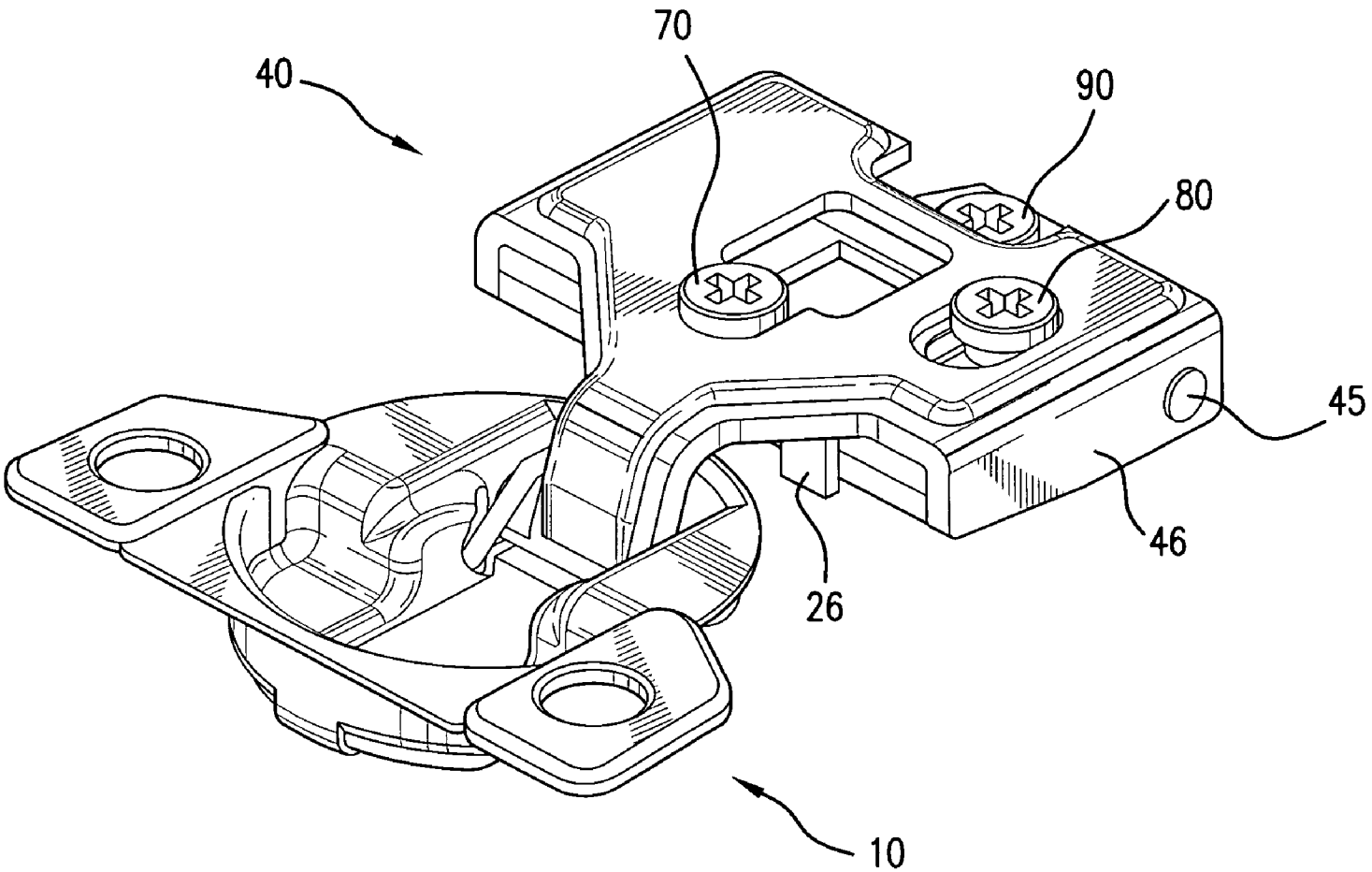
FIG. 1 is a front perspective view of a hinge assembly in an embodiment of the present invention.
Figure 2:
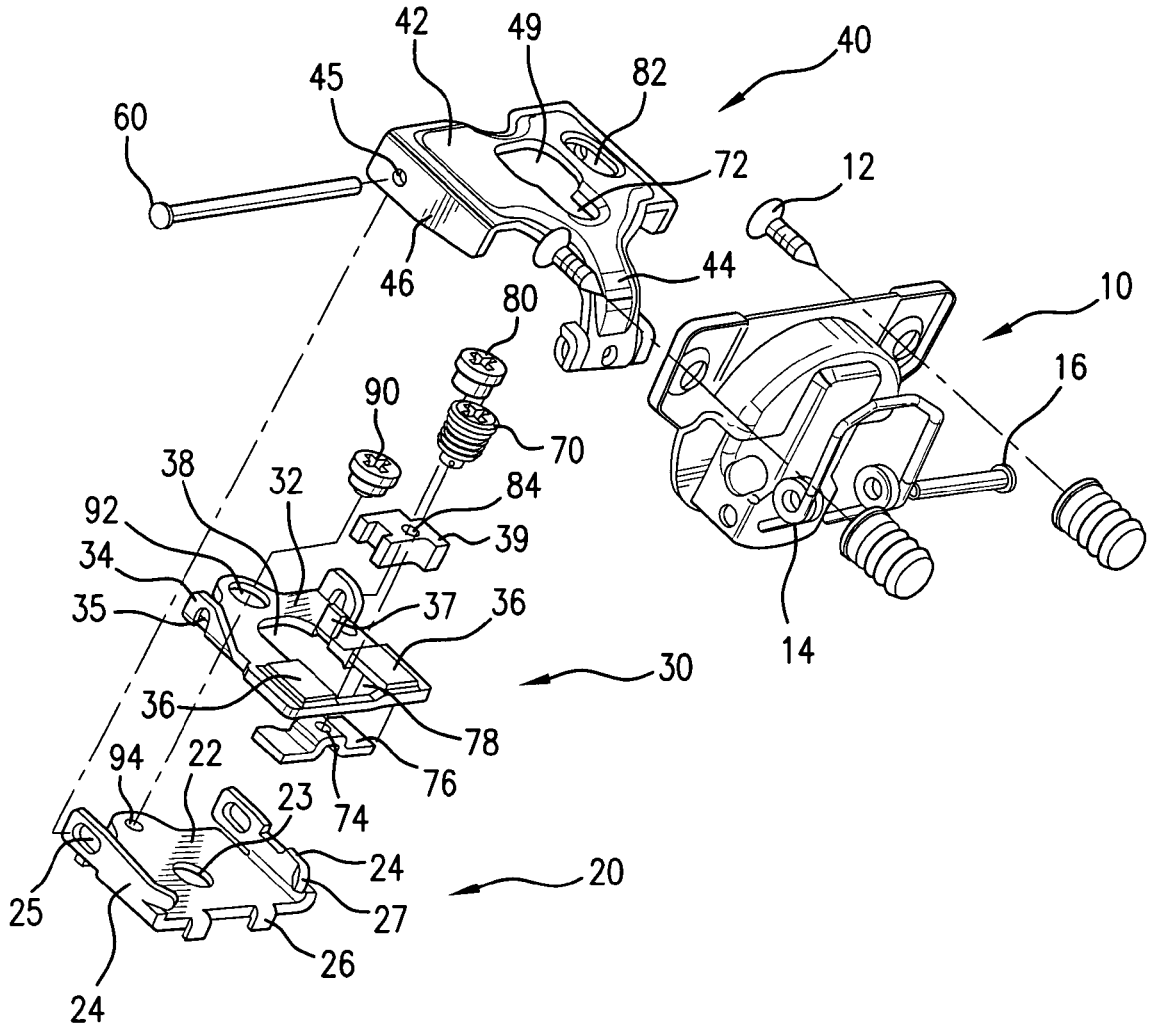
FIG. 2 is a side perspective exploded view of a hinge assembly in an embodiment of the present invention.
Figure 3:
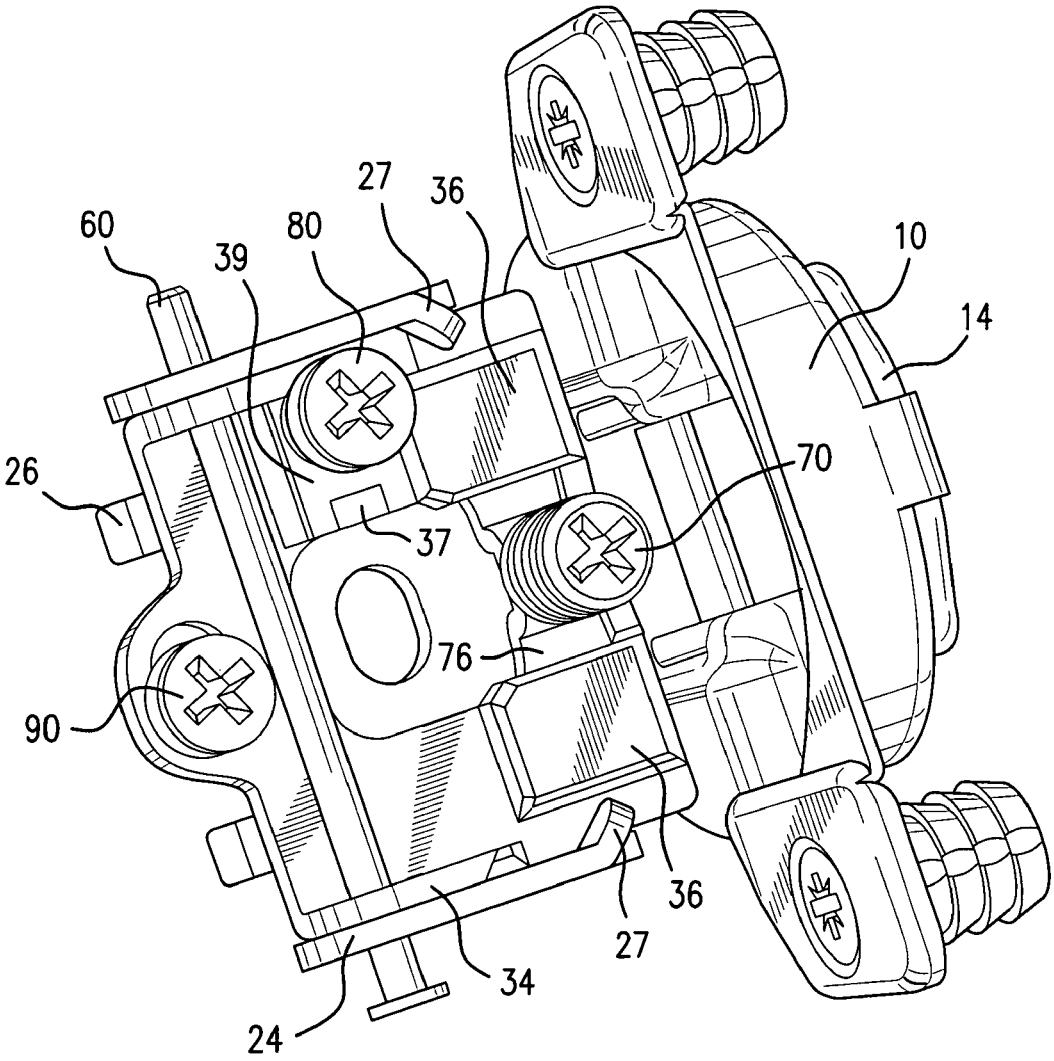
FIG. 3 is a top view of a hinge assembly with the top plate removed in an embodiment of the present invention.

For the purposes of promoting an understanding of the invention, reference will now be made to some preferred embodiments of the present invention as illustrated in FIGS. 1–3, and specific language used to describe the same. Numerous specific details are set forth below in order to provide a thorough understanding of the present invention. However, it will be obvious to one skilled in the art, that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

During the description of the many embodiments of the present invention, directional orientation will be used to distinguish among the three degrees of adjustment of the hinge assembly. For the purposes of this discussion, reference will be made to a hinge prior to installation wherein "front" refers to the portion of the hinge assembly closest to the hinge cup, which when installed, will be closest to the furniture door, with "rear" referring to the portion of the hinge assembly farthest from the hinge cup and that which will be facing the rear of the furniture cabinet when installed. The "bottom" of the hinge assembly is that which will be closest to the furniture frame when installed, with "top" being the opposite direction. These parameters are meant to be used for descriptive purposes only and as one skilled in the art will recognize, the hinge assembly may be mounted in an article of furniture in any orientation.

Referring now to FIGS. 1–3, there is shown various views of one embodiment of a three-dimensionally mechanically adjustable hinge assembly of the present invention wherein the three mechanical adjustment means are independent of one another. Hinges of the present invention may be used to hang a furniture door to the frame of a furniture article, such as a cabinet. FIG. 1 shows a top perspective view of a hinge assembly in an open position (as it would appear when the cabinet door is open). FIG. 2 shows a side perspective exploded view of a hinge assembly in an embodiment of the present invention so that all the individual parts of hinge assembly can be more readily seen and understood. FIG. 3 shows a top view of a hinge assembly in an embodiment of the present invention wherein the top plate has been removed so as to illustrate the interior of the assembly.

In a first aspect of the present invention, the hinge assembly is based on a four-part hinge assembly comprising a hinge cup 10, pivotably connected to a top plate 40 via a hinge arm segment 44 which depends from the front portion thereof and is integral with the top plate 40. The top plate 40 is slideably engaged to an intermediate plate 30, the combination of which is slideably engaged to a mounting plate 20. The mounting plate 20 is secured to a furniture frame member and the hinge cup 10 is secured to a furniture door.

The hinge cup 10 is mountable flush in a bore hole in the back of a door with fastening screws 12 in a known manner, and includes a spring 14 so as to facilitate automatic closing of a door once the hinge has been partially closed. The hinge cup 1 is pivotably connected to the hinge arm 44 with a pin 16 which extends through apertures in the rear of the hinge cup 1 and provides a rotational surface for the end of the hinge arm to engage as is known in the art. Other hinge arm designs may also be used with the present invention, for example the hinge arm 44 may be separate from, but engaged to the top plate 40.

Mounted to the furniture frame member are the mounting plate 20, intermediate plate 30, and top plate 40. The mounting plate 20 comprises a substantially flat body portion 22 having a front end, a rear end, and two sides. In a preferred embodiment of the present invention, the mounting plate is provided with a mounting aperture 23 for accepting a mounting screw which secures the mounting plate 20 to the furniture frame member. In a most preferred embodiment of the present invention, the mounting aperture 23 is positioned proximate to the center of the body portion 22 and is elongated in a direction parallel to the front and rear ends of the body portion 22 to allow adjustment of the mounting plate 20 relative to the furniture frame member during installation.

The two sides of the mounting plate 20 are provided with side members 24 extending vertically upwards from the body portion 22 toward the top of the hinge assembly. The side members each comprise at least one aperture 25 for receiving a guide pin 60. In a preferred embodiment of the present invention, the apertures 25 are positioned proximate to the rear end of the mounting plate and are elongated in a direction parallel to the side of the mounting plate 20.

In an additional preferred embodiment of the present invention, the side members 24 are provided with front catch means 27 for engaging and retaining a portion of the intermediate plate 30. The front catch members 27 are preferably formed from a portion of the side member 24 which is angled inward toward the center of the body portion 22. This forms a thin space between the bottom of the front catch means 27 and the body portion 22 of the mounting plate 20. The intermediate plate 30 slides into this thin space and is slideably retained thereby by the front catch members 27.

In a further embodiment of the present invention, the body portion 22 is further provided with a circular aperture 94 for receiving the off center rod of a cam screw. This circular aperture 94 is preferably located toward the rear of the body portion 22 and centered laterally between the two side members 24.

In another preferred embodiment of the present invention, the mounting plate 20 further comprises legs 26 depending from the body portion 22 along a front end and a rear end. The legs 26 engage the sides of the furniture frame member and assist in retaining the hinge assembly in position with respect to the frame member. In an alternate embodiment of the present invention, one leg 26 is provided extending across substantially each of the front and the rear of the body portion 22 of the mounting plate 20.

The intermediate plate 30 is slideably engaged to the mounting plate 20 such that it is free to move front to rear relative to the fixed mounting plate 20. The intermediate plate 30 comprises a substantially flat body portion 32 having two side flanges 34 on either side thereof and a front end and a rear end. A central aperture 38 is preferably provided to allow access, through the intermediate plate 30, to the mounting screw engaging the mounting plate 20 to the furniture frame. In a preferred embodiment of the present invention, the intermediate plate is also provided with a circular aperture 74 associated therewith for receiving the end of a threaded adjustment screw 70.

In a preferred embodiment of the present invention, the side flanges 34 extend vertically upward from the body portion 32, toward the top plate 40. Apertures 35 are provided on the flange 34 and are aligned with the apertures 25 in the mounting plate 20 for receiving the guide pin 60. In a preferred embodiment of the present invention, the apertures 35 in the intermediate plate are circular and located toward the rear of the intermediate plate 30. The side flanges 34 of the intermediate plate 30 are preferably spaced closer to one another than the side members 24 of the mounting plate 20. In this manner, the intermediate plate 30 and flanges 34 fit between and are encompassed by the side members 24 of the mounting plate.

Additionally, the front of the body portion 32 of the intermediate plate 30 slides under and is slideably retained by the front catch members 27 of the mounting plate 20. When engaged to the mounting plate 20 with the pin 60, the intermediate plate 30 is free to slide from front to rear relative to the mounting plate 20 by sliding, along with the pin, through the range of motion provided by the elongated apertures 25 in the side members 24 of the mounting plate 20. Through the interaction between the guide pin 60 in the rear and the front catch members 27 in the front of the mounting plate 20, the intermediate plate 30 is retained and held securely to the mounting plate 20, preventing separation of the two plates while maintaining the slideable connection.

The top plate 40 is positioned over and encompasses the intermediate plate 30 and mounting plate 20. The top plate 40 comprises a body portion 42 having a front end, a rear end, and two sides. The body portion 42 further comprises a central aperture 49 aligned with the central aperture 38 of the intermediate plate 30 to allow access to the mounting screw engaging the mounting plate 20 to the furniture frame. The body portion is provided with an aperture 72 for receiving a threaded portion of a threaded screw 70. The body portion 42 is further provided with an elongated aperture 82 for receiving a cam screw 80 positioned proximate to one side of the body portion 42. Depending from the front end of the body portion 42 is a hinge arm portion 44 which extends downward to pivotably engage the hinge cup 10. In another embodiment of the present invention, the hinge arm portion 44 comprises an additional hinge assembly part which is securely engageable to the top plate 40, though the use of screws, clips or the like.

In an alternate embodiment of the present invention, the configuration of the apertures for receiving the guide pin 60 on the mounting plate 20, intermediate plate 30, and top plate are reversed. In this alternate embodiment, the apertures 25 on the side members 24 of the mounting plate 20 are circular, and similarly, the apertures 35 on the side flanges 34 of the intermediate plate 30 and the apertures 45 on the side members 46 of the top plate 40 are elongated. This configuration, though opposite of that found in the preferred embodiment, will still provide a slideable connection between the mounting plate 20 and the intermediate plate 30 and top plate 40, which allows the intermediate plate 30 and top plate 40 to slide from front to rear relative to the mounting plate 20.

To illustrate the position of the various plates and pins in the assembled hinge assembly, FIG. 2 shows an exploded side view of a preferred embodiment of the present invention, and FIG. 3 illustrates a view of an assembled hinge with the top plate removed in an embodiment of the present invention. The guide pin 60 extends through a first rounded aperture in one side member 46 of the top plate 40, then through a first elongated aperture 25 in one side 24 of the mounting plate 20, then through a first circular aperture 35 in a side flange 34 of the intermediate plate 30. The pin continues across the interior body of the hinge assembly, extending through the corresponding second round aperture 35 in the side member 34 of the intermediate plate 30, then through the second elongated aperture 25 in the second side member 24 of the mounting plate 20, and finally through the second circular aperture 45 in the side member 46 of the top plate 40.

This configuration connects and engages the three plates such that they are slideable and adjustable relative to one another. The adjusting of the plates is accomplished through the threaded screw 70 and cam screws 80 and 90. Through the combination of these three adjustment means, the hinge assembly and, therefore, the furniture door are adjustable in all three dimensions relative to the furniture frame.

The threaded screw 70 is at least partially threaded toward the top portion of the screw and extends through the aperture designed for receiving a threaded screw 72 in the top plate 40. This aperture comprises sides which engage and ride along the threads of the threaded screw 70. The lower portion of the threaded screw extends into an aperture 74 associated with the intermediate plate 30. In one embodiment of the present invention, the aperture 74 associated with the intermediate plate 30 comprises an aperture in the body portion of the plate 30. In another embodiment of the present invention, this aperture 72 is positioned in a raised area of the body portion 32. To provide a slideable connection between the top plate 40 and the intermediate plate 30, this aperture 74 is preferably elongated in a direction parallel to the front of the hinge assembly, such that the lower portion of the threaded screw 70 can slide with the top plate 40 during adjustments.

In a most preferred embodiment of the present invention, a clip is used to provide the slideable connection between the threaded screw 70 and the intermediate plate 30. In this embodiment a clip 76 is provided which is positioned between the mounting plate 20 and the intermediate plate 30 with a portion of the clip 76 protruding through an aperture 78 in the intermediate plate 30. This aperture may be flanked by slightly raised portions 36 of the intermediate plate 30 which create a space there under for the clip 76. A circular aperture 74 is provided in the raised potion of the clip 76 for receiving and engaging the lower portion of the threaded screw 70.

When the threaded screw 70 is rotated, the top plate 40 rides up or down the threaded screw through the interaction of the threads with the aperture surrounding the threaded screw. This causes the front of the top plate 40 to move up and down while the rear of the top plate 40 pivots on the guide pin 60. This motion of the front portion of the top plate 40 causes the hinge cup and furniture door to move from side to side relative to the furniture frame, thereby providing adjustment of the door in a lateral direction.

The side cam screw 80 extends through the elongated aperture 82 in the body portion 42 of the top plate 40. The elongated aperture is preferably located proximate to one side of the body portion and elongated in a direction parallel to the side. The off center rod of the cam screw 80 extends through the elongated aperture 82 and engages a circular aperture 84 associated with the body portion 32 of the intermediate plate 30. The off center rod rotates within the circular aperture 84 causing the top of the cam screw to spin on an eccentric axis within the elongated aperture 82 which in turn causes the top plate 40 to move side to side relative to the intermediate plate 30.

In a preferred embodiment of the present invention, the aperture 84 associated with the body portion 32 of the intermediate plate 30 is provided on a raised surface of said intermediate plate 30. A mounting block 39, comprising a small solid block is positioned between said intermediate plate 30 and said top plate 40. The mounting block 39 provides a raised surface comprising a circular aperture 84 for receiving the off center rod of the cam screw 80. This configuration allows the off center rod of the cam screw to be shorter in length because it is not necessary for the off center rod to reach to the body portion of the intermediate plate 30. This provides greater strength to the adjustment apparatus and further provides increased strength to the hinge assembly. In a still further preferred embodiment of the present invention, a vertically extending member 37 of the body portion 32 provides an alignment and retainment means while securing the mounting block 39 within the hinge assembly between the intermediate plate 30 and top plate 40.

When the side cam screw 80 is rotated, the intermediate plate 30 remains stationary and engaged to the mounting plate 20, while the top plate 40 moves from side to side relative to the two lower plates 20, 30. As the top plate 40 moves from side to side, the hinge arm 44, hinge cup 10 and furniture door are adjusted up and down relative to the furniture frame member. In this manner the position of the furniture door relative to the floor and furniture frame member may be adjusted by rotating the side cam screw 80. In a preferred embodiment of the present invention, the guide pin 60 will move along with the top plate 40 through the motion of the adjustment, sliding side to side through the apertures 25, 35 associated with the intermediate plate 30 and mounting plate 20.

The rear cam screw 90 extends through the elongated aperture 92 in the body portion 32 of the intermediate plate 30. The elongated aperture 92 is preferably located proximate to the rear of the body portion 32 and elongated in a direction parallel to the rear end. The off center rod of the cam screw 90 extends through the elongated aperture 92 and engages a circular aperture 94 provided toward the rear of the body portion 22 of the mounting plate 20. The off center rod rotates within the circular aperture 94 causing the top of the cam screw to spin on an eccentric axis within the elongated aperture 92 which in turn causes the intermediate plate 30 to move from front to rear relative to the mounting plate 20.

Throughout this motion, the top plate 40 remains stationary relative to the intermediate plate 30 and moves with the intermediate plate 30 relative to the mounting plate 20. The side guide pin 60 extending through the top plate 40, intermediate plate 30, and mounting plate 20 moves with the top and intermediate plates 30, 40 while sliding within the elongated apertures 25 in the mounting plate 20.

Although the present invention has been described with reference to particular embodiments, it should be recognized that these embodiments are merely illustrative of the principles of the present invention. Those of ordinary skill in the art will appreciate that the apparatus and methods of the present invention may be constructed and implemented in other ways and embodiments. Accordingly, the description herein should not be read as limiting the present invention, as other embodiments also fall within the scope of the present invention.

What is claimed is:

1. A hinge assembly for mounting a door on a furniture frame for movement of the door between open and closed positions of the door relative to the furniture frame, the assembly comprising:

a mounting plate adapted to be affixed to a furniture frame member, said mounting plate having first and second side members and front and rear ends, wherein said mounting plate comprises a leg depending from the front end and the rear end of the mounting plate in a direction opposite said side members, said legs positioned and aligned to engage and secure said mounting plate to said furniture frame, and wherein said mounting plate comprises two front catch members located on said side members proximate to the front of the mounting plate and angled inward;

an intermediate plate disposed atop of and slideably engaged to said mounting plate;

a top plate disposed atop of and slideably engaged to said intermediate plate and said mounting plate, and further comprising a hinge arm extending from a front portion thereof;

a guide pin extending through a rearward portion of said top plate, through a rearward portion of said intermediate plate, and through a rearward portion of said mounting plate such that said top plate is pivotable upon said guide pin; and, wherein said hinge assembly is adjustable such that the hinge arm can be adjusted in three dimensions relative to the mounting plate.

2. The hinge assembly of claim 1, wherein said top plate further comprises a body portion having an elongated aperture in said body portion of said top plate positioned proximate to one side of said top plate and elongated in a direction parallel to said side, said top plate disposed atop of and slideably engaged to said intermediate plate and said mounting plate; and, a cam screw extending through said elongated aperture in the top plate and engaging an aperture associated with said intermediate plate;

wherein by rotating said cam screw about an eccentric axis in said elongated aperture, said top plate moves from side to side relative to said intermediate plate and said mounting plate, thereby adjusting a hinge cup and said door up and down relative to said furniture frame.

3. The hinge assembly of claim 1, wherein said top plate further comprises a first and second side member depending from either side thereof each comprising an aperture, said intermediate plate further comprises a first and second side flange each comprising an aperture, said first and second side members of said mounting plate each comprising an elongated aperture;

wherein said hinge assembly further comprising a guide pin extending through said aperture in said first side member of the top plate, said aperture in said first elongated aperture of said mounting plate, said aperture in said first side flange of said intermediate plate, across the body of said intermediate plate, and into said aperture in said second flange of said intermediate plate, said elongated aperture in said side member of said mounting plate, and into said aperture in said second side member of said top plate.

4. The hinge assembly of claim 1, further comprising a rear cam screw positioned proximate a rear portion of the hinge assembly and extending through an elongated aperture in said rear portion of the intermediate plate elongated in a direction parallel to said rear portion, and into a circular aperture in a rear portion of said mounting plate, such that by rotating the rear cam screw, the intermediate plate slides front to rear relative to the mounting plate, said pin and said top plate with a hinge arm connected to a hinge cup moving with said intermediate plate, thereby causing the furniture door to move in and out relative to the furniture frame.

5. The hinge assembly of claim 1, further comprising a front threaded screw extending through an aperture in said top plate configured for receiving and engaging the threads of the threaded screw, and extending into an aperture associated with said intermediate plate;

wherein rotating said threaded screw causes the top plate to ride up and down along the threads of the screw thereby moving a hinge cup and the door from left to right with respect to the furniture frame.

6. The hinge assembly of claim 5, further comprising a clip positioned between said mounting plate and said intermediate plate wherein a portion of said clip is raised and protrudes through an aperture in said intermediate plate, and wherein said aperture associated with said intermediate plate comprises a circular aperture formed in said raised portion of said clip.

* * * * *